US009129794B2

(12) United States Patent
Ranish

(10) Patent No.: US 9,129,794 B2
(45) Date of Patent: Sep. 8, 2015

(54) TUBULAR LIGHT SOURCE HAVING OVERWIND

(71) Applicant: Applied Materials, Inc., Santa Clara, CA (US)

(72) Inventor: Joseph M. Ranish, San Jose, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 0 days.

(21) Appl. No.: 14/203,046

(22) Filed: Mar. 10, 2014

(65) Prior Publication Data

US 2014/0265824 A1 Sep. 18, 2014

Related U.S. Application Data

(60) Provisional application No. 61/788,137, filed on Mar. 15, 2013.

(51) Int. Cl.

| | |
|---|---|
| ***H01K 1/14*** | (2006.01) |
| ***H01K 1/04*** | (2006.01) |
| ***H01K 5/02*** | (2006.01) |
| ***H01K 1/10*** | (2006.01) |
| ***H01K 1/28*** | (2006.01) |

(52) U.S. Cl.
CPC .. *H01K 5/02* (2013.01); *H01K 1/04* (2013.01); *H01K 1/10* (2013.01); *H01K 1/14* (2013.01); *H01K 1/28* (2013.01)

(58) Field of Classification Search
CPC ..... H01K 1/00–1/70
USPC ..... 313/315–316, 578–579
See application file for complete search history.

(56) References Cited

U.S. PATENT DOCUMENTS

| | | | | |
|---|---|---|---|---|
| 2,306,925 | A * | 12/1942 | Aicher | 313/343 |
| 4,277,714 | A * | 7/1981 | Keeffe et al. | 313/628 |
| 4,686,412 | A * | 8/1987 | Johnson, Jr. | 313/344 |
| 4,918,354 | A * | 4/1990 | Johnson, Jr. | 313/279 |
| 6,129,890 | A * | 10/2000 | Lunk et al. | 419/4 |
| 2003/0122464 | A1 | 7/2003 | Kurosawa et al. | |
| 2004/0056584 | A1 * | 3/2004 | Gerard de Cort et al. | 313/493 |
| 2004/0070324 | A1 * | 4/2004 | Lisitsyn | 313/271 |
| 2007/0108901 | A1 | 5/2007 | Goijaerts et al. | |
| 2008/0199163 | A1 | 8/2008 | Ranish et al. | |

FOREIGN PATENT DOCUMENTS

| | | |
|---|---|---|
| EP | 1 182 690 A1 | 2/2002 |
| WO | 02/01601 A1 | 1/2002 |

OTHER PUBLICATIONS

PCT Notification of Transmittal of the International Search Report and the Written Opinion of the International Searching Authority for International Application No. PCT/US2014/022091 dated May 26, 2014; 14 total pages.

* cited by examiner

*Primary Examiner* — Mariceli Santiago
(74) *Attorney, Agent, or Firm* — Patterson & Sheridan, LLP

(57) ABSTRACT

Embodiments of the present invention generally relate to a tubular lamp with a coiled filament having an overwind wrapped around the coil. In one embodiment, the tubular lamp has a coiled coil filament, and the coiled coil has an overwind wrapped around the coiled coil.

16 Claims, 7 Drawing Sheets

TUBULAR LIGHT SOURCE HAVING OVERWIND

CROSS-REFERENCE TO RELATED APPLICATIONS

This application claims priority to U.S. Provisional Patent Application Ser. No. 61/788,137, filed on Mar. 15, 2013, which herein is incorporated by reference.

BACKGROUND

1. Field

Embodiments of the present invention generally relate to a tubular lamp. More particularly, embodiments described herein relate to a tubular lamp for a rapid thermal processing (RTP) apparatus.

2. Description of the Related Art

RTP systems are employed in semiconductor chip fabrication to create, chemically alter, or etch surface structures on semiconductor substrates or wafers. RTP typically depends upon an array of high-intensity incandescent lamps fit into a lamphead and directed at the substrate. The lamps are electrically powered and can be very quickly turned off and on and a substantial fraction of their radiation can be directed to the substrate. As a result, the substrate can be very quickly heated without substantially heating the chamber and can be nearly as quickly cooled once the power is removed from the lamps.

Typically the lamps for RTP apparatus are single-ended lamps each having a socket for electrical contact disposed at one end of the lamp. The single-ended lamps generally are oriented vertically with respect to the substrate. In this configuration, only the end opposite the socket is directed at the substrate, while the elongated body of the lamp radiates heat in a direction that is parallel to the substrate. Typically, about half of the radiant energy from the lamp goes out towards the substrate. About half of the radiant energy from the lamp is absorbed in the lamp and in the lamphead structure. This can cause the lamp to reach much higher temperatures as compared to a lamp radiating in open space. If the lamp gets too hot, the average lamp lifetime can be substantially reduced. Heat absorbed in the lamphead can also cause the lamphead to deform. One approach to maintain the same radiation energy output while reducing the filament temperature is to increase the surface area of the filament inside the single-ended lamp, such as providing an overwind to the filament. However, it is desired to have a higher heating efficiency and lower filament temperature.

Therefore, there is a need for an improved lamp for a RTP apparatus.

SUMMARY

Embodiments of the present invention generally relate to a tubular lamp with a coil filament having an overwind wrapped around the coil. In one embodiment, the tubular lamp has a coiled coil filament, and the coiled coil has an overwind wrapped around the coiled coil.

In one embodiment, a tubular lamp is disclosed. The tubular lamp includes a tubular envelope having a first end and a second end, and a coiled filament having a first diameter. The coiled filament extends from the first end to the second end of the tubular envelope and has an overwind having a second diameter. The tubular lamp further includes a ratio of the first diameter to the second diameter ranging from about 3:1 to about 15:1.

In another embodiment, a tubular halogen lamp for a RTP apparatus is disclosed. The tubular halogen lamp includes an envelope having a first end and a second end, and a coiled filament extending from the first end to the second end. The coiled filament has an overwind.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Embodiments of the present invention generally relate to a tubular lamp with a coil filament having an overwind wrapped around the coil. In one embodiment, the tubular lamp has a coiled coil filament, and the coiled coil has an overwind wrapped around the coiled coil.

Figure 1:
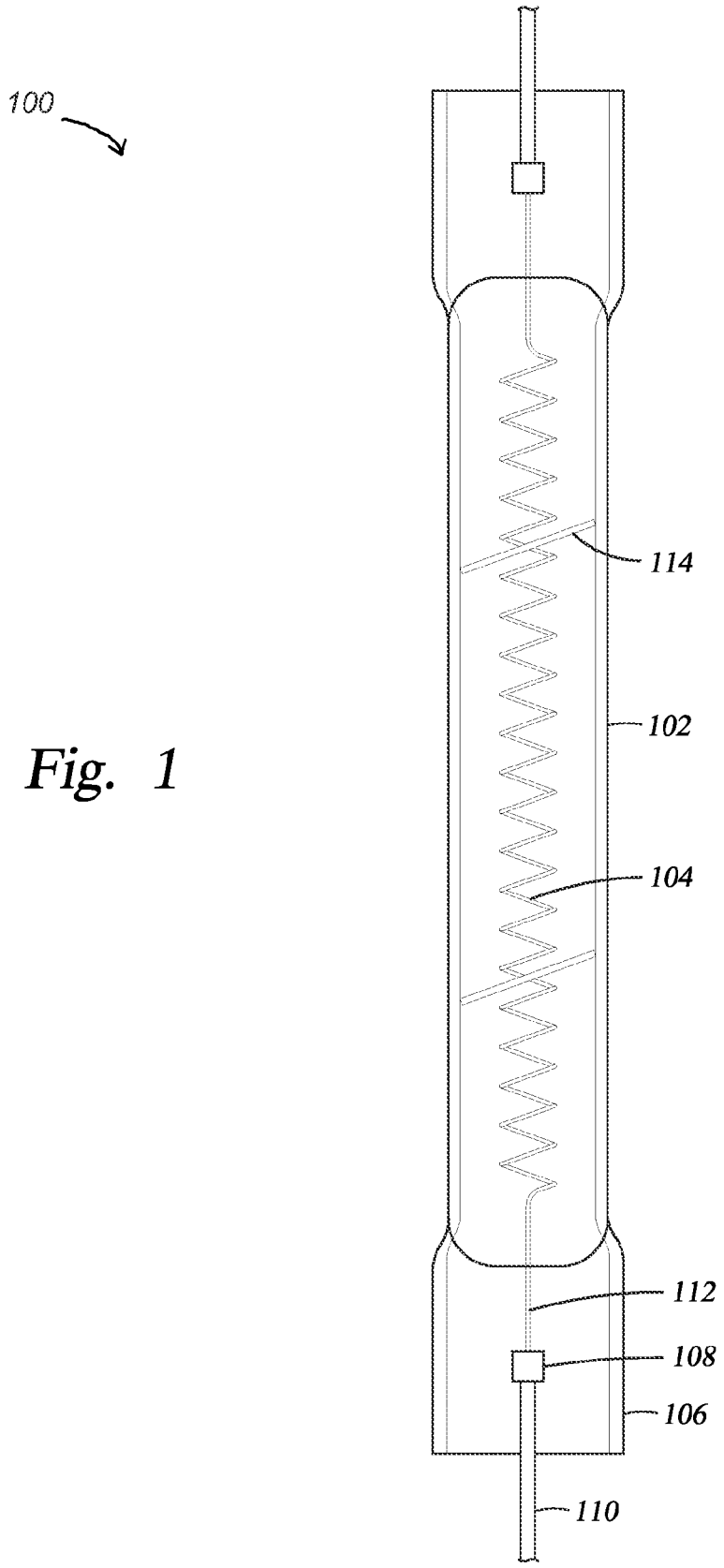
FIG. 1 is a side view of a tubular lamp according to an embodiment of the invention.

FIG. 1 is a side view of a tubular lamp 100 according to an embodiment of the invention. The tubular lamp 100 may be an incandescent lamp. In one embodiment, the tubular lamp 100 is a halogen lamp. The tubular lamp 100 has a tubular envelope 102 having two ends. Each end is connected to a lamp base 106. The envelope 102 may be made of light-transmissive materials, such as quartz, silica glass, or aluminosilicate glass. The cross section of the tubular envelope 102 may be a circle. The cross section of the tubular envelope 102 may have a non-circular shape, such as square, rectangle, triangle, or polygonal. The envelope 102 may be substantially linear or may take on the form of an arc or series of arcs and straight sections rather than the simpler straight form shown in FIG. 1. The envelope 102 may be a loop where the two ends of the envelope 102 abut. In one embodiment, the envelope 102 is circular.

The lamp base 106 contains a foil 108 that is used to couple a lead-in conductor 110 to a second lead-in conductor 112. The lead-in conductors 110, 112 may be made of a material having good electrical conductivity, such as molybdenum, tungsten, nickel plated steel, or any other metal with a low electrical resistance and the ability to reliably carry high currents. Typically, for halogen lamps the lead-in conductor 112 is made of molybdenum or tungsten. For silica envelopes, the foil seal is made of molybdenum.

During the manufacturing of the tubular lamp, the lamp base 106 is pressed together over the foil area to form a press seal that hermetically seals the tubular envelope 102. In one embodiment, the sealed envelope 102 is filled with a halogen containing gas. A radiation generating filament 104, which is shown in the form of a coil, is disposed in the envelope 102 and extends an axial length of the envelope 102. The ends of the filament 104 are coupled to the second lead-in conductor 112. The filament 104 may be a resistive metal wire, such as a tungsten wire or a potassium doped tungsten wire. The electrical properties of the filament 104 can be tuned by adjusting parameters such as weight per unit length, diameter, and coiling parameters. In operation, the filament 104 can produce radiation at a wattage range of up to about 1 kW with operating voltages of about 120 V. Typically, the radiation is in the deep ultraviolet, ultraviolet, visible, or near infrared ranges.

In one embodiment, the filament 104 is a coil having an overwind wrapped around the coil. In another embodiment, the filament 104 is a coiled coil having an overwind wrapped around the coiled coil. The overwind on the coil or the coiled coil increases the surface area of the filament and as a result, the intensity of the radiation increases. Another result of the increased surface area of the filament 104 is to operate the tubular lamp 100 at a lower filament temperature while having the same radiation output.

A plurality of filament support 114 is disposed spaced apart along the filament 104 inside the envelope 102. The filament support 114 may be a thin wire connected to the filament 104 and may extend outwardly to the wall of the envelope 102 to reduce the opportunity for the filament 104 to sag. The filament support 114 is placed along the filament 104 periodically. In one embodiment, the filament support 114 is placed every 2 cm along the filament 104. The filament support 114 may be made of a resistive metal, such as tungsten. Any suitable filament support may be used as the filament support 114.

Figure 2:
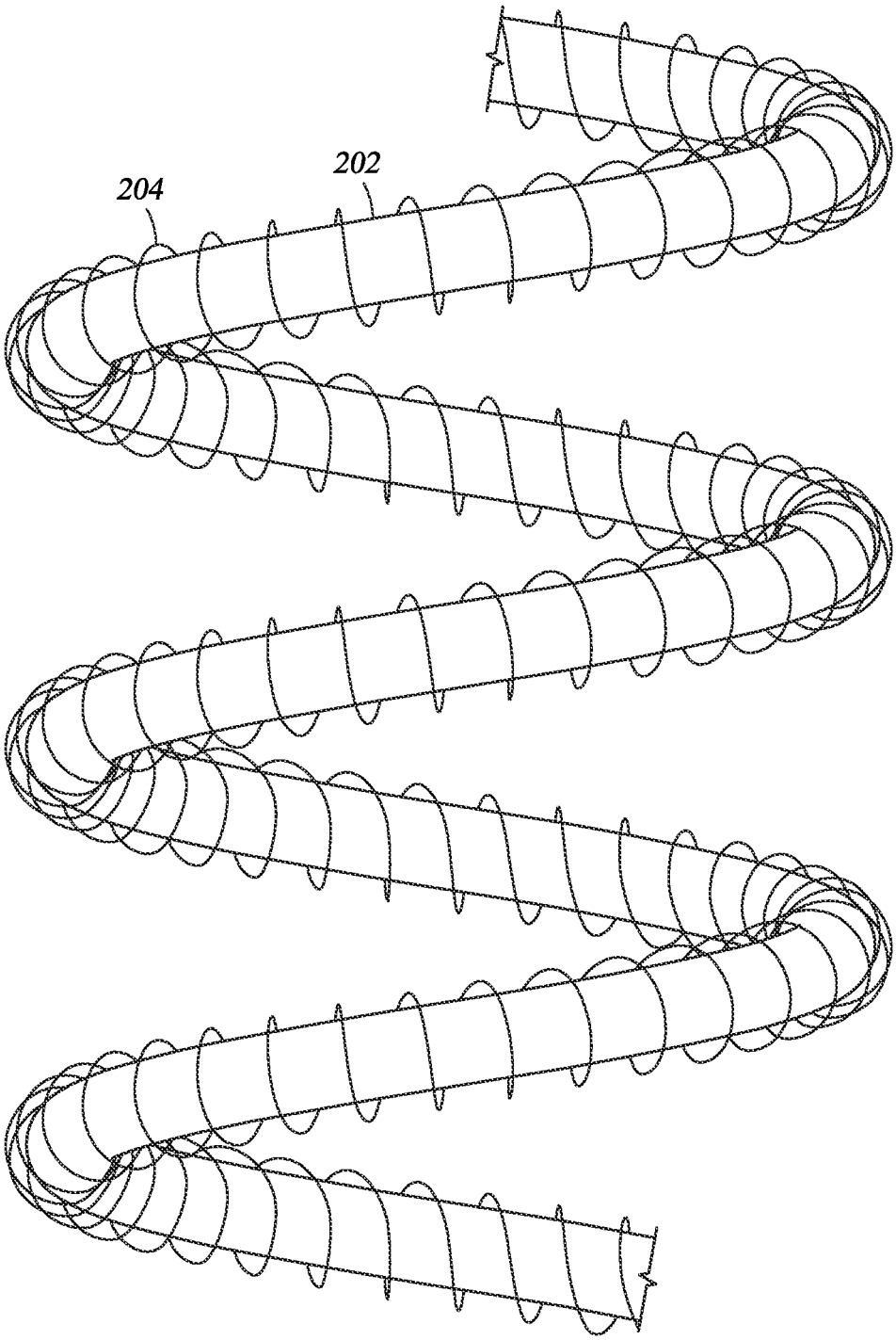
FIG. 2 is an enlarged partial side view of a filament inside the tubular lamp of FIG. 1 according to one embodiment of the invention.

FIG. 2 is an enlarged partial side view of the filament 104 inside the tubular lamp 100 of FIG. 1 according to one embodiment of the invention. As shown in FIG. 2, the filament 104 has a primary coil 202 and an overwind 204 wrapped around the primary coil 202. The primary coil 202 and the overwind 204 may be a resistive metal, such as tungsten or potassium doped tungsten. In one embodiment, the primary coil 202 is made of potassium doped tungsten and the overwind 204 is made of tungsten. In another embodiment, both the primary coil 202 and the overwind 204 are made of potassium doped tungsten. The overwind 204 may increase the surface area of the filament by about 40% to about 80%. With an increased surface area, the filament 104 may produce the same amount of radiant energy at a lower filament temperature.

A plurality of tubular lamps such as the tubular lamp 100 with the filament 104 having the overwind 204 may be placed in a RTP apparatus. The tubular lamps 100 may be substantially parallel to the substrate. With the elongated body of the tubular lamp 100 emitting radiation towards the substrate, the substrate may be heated more efficiently compared to heating by single-ended lamps. In addition, with the horizontal orientation, the tubular lamps may radiate more directly to the substrate with little reabsorption, in contrast to a single-ended lamp which typically exhibits substantial reabsorption. The tubular lamps may be disposed in reflectors to capture radiation emitted away from the substrate, if desired.

The overwind 204 may have a smaller diameter than the primary coil 202. The ratio of the diameter of the primary coil 202 to the diameter of the overwind 204 may range from about 3:1 to about 15:1, such as between about 6:1 and about 12:1. In one embodiment, the ratio is about 10:1. The overwind 204 may have a pitch ratio between about 1.1 and about 2.0. The pitch ratio is the distance between two complete turns divide by the diameter of the overwind. In one embodiment, the pitch ratio is about 1.4.

Prolonged exposure to high temperature may "melt" the overwind 204 into the primary coil 202. However, for a process performed in a RTP chamber, such as annealing, the spike in temperature has a typical high temperature exposure of less than 1 second. Thus, a tubular lamp with an overwind such as the overwind 204 may be useful in a RTP chamber.

Figure 3:
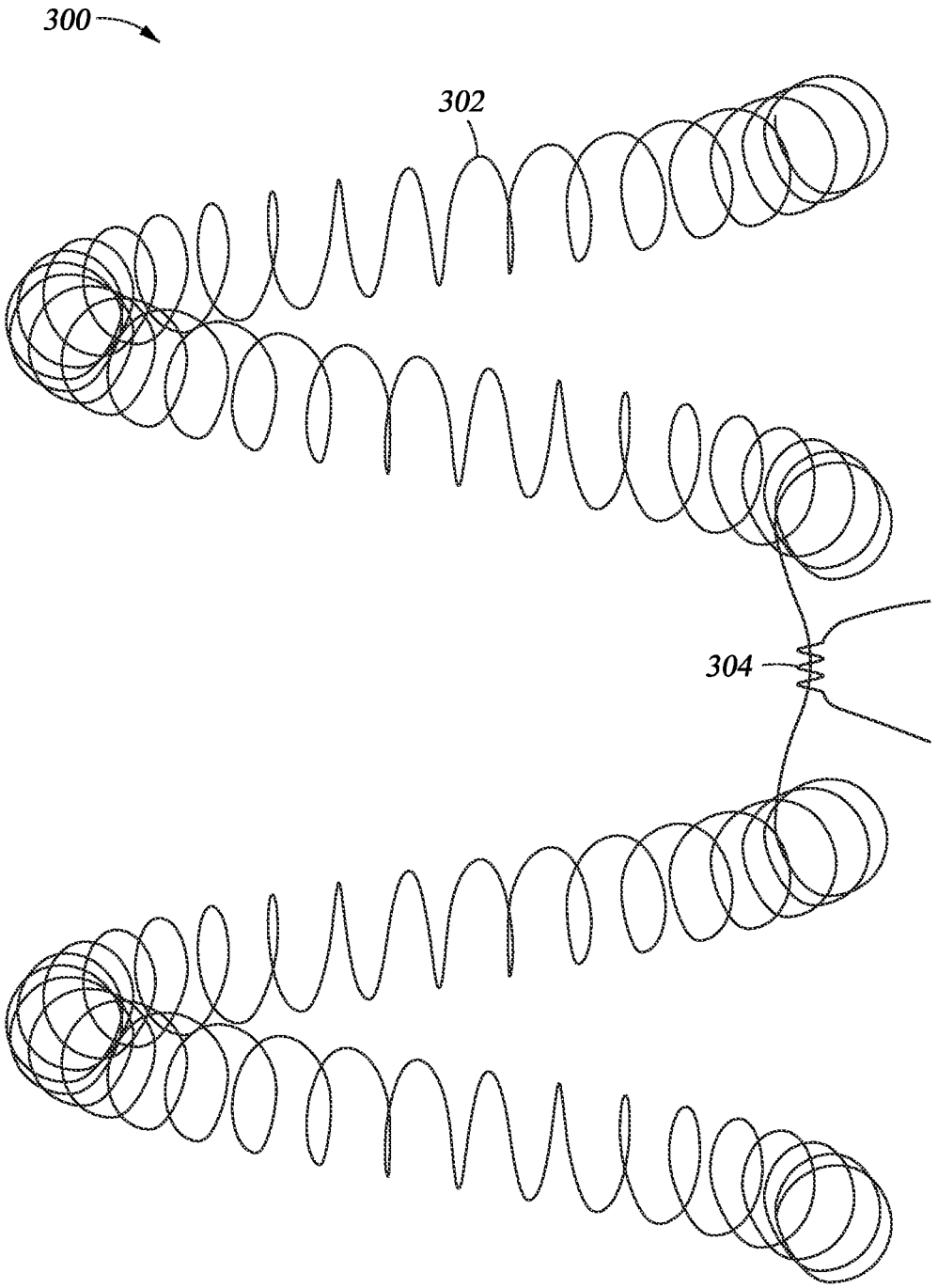
FIG. 3 is an enlarged partial side view of a filament inside the tubular lamp of FIG. 1 according to another embodiment of the invention.

FIG. 3 is an enlarged partial side view of a filament 300 inside the tubular lamp 100 of FIG. 1 according to another embodiment of the invention. The filament 300 has a primary coiled coil 302 and an overwind 304 wrapped around the primary coiled coil 302. Again the ratio of the diameter of the primary coiled coil 302 to the diameter of the overwind 304 may range from about 3:1 to about 15:1, such as between about 6:1 and about 12:1. In one embodiment, the ratio is about 10:1. The overwind 304 may have a pitch ratio between about 1.1 and about 2.0. In one embodiment, the overwind 304 may have a pitch ratio of about 1.4.

Figure 4A:
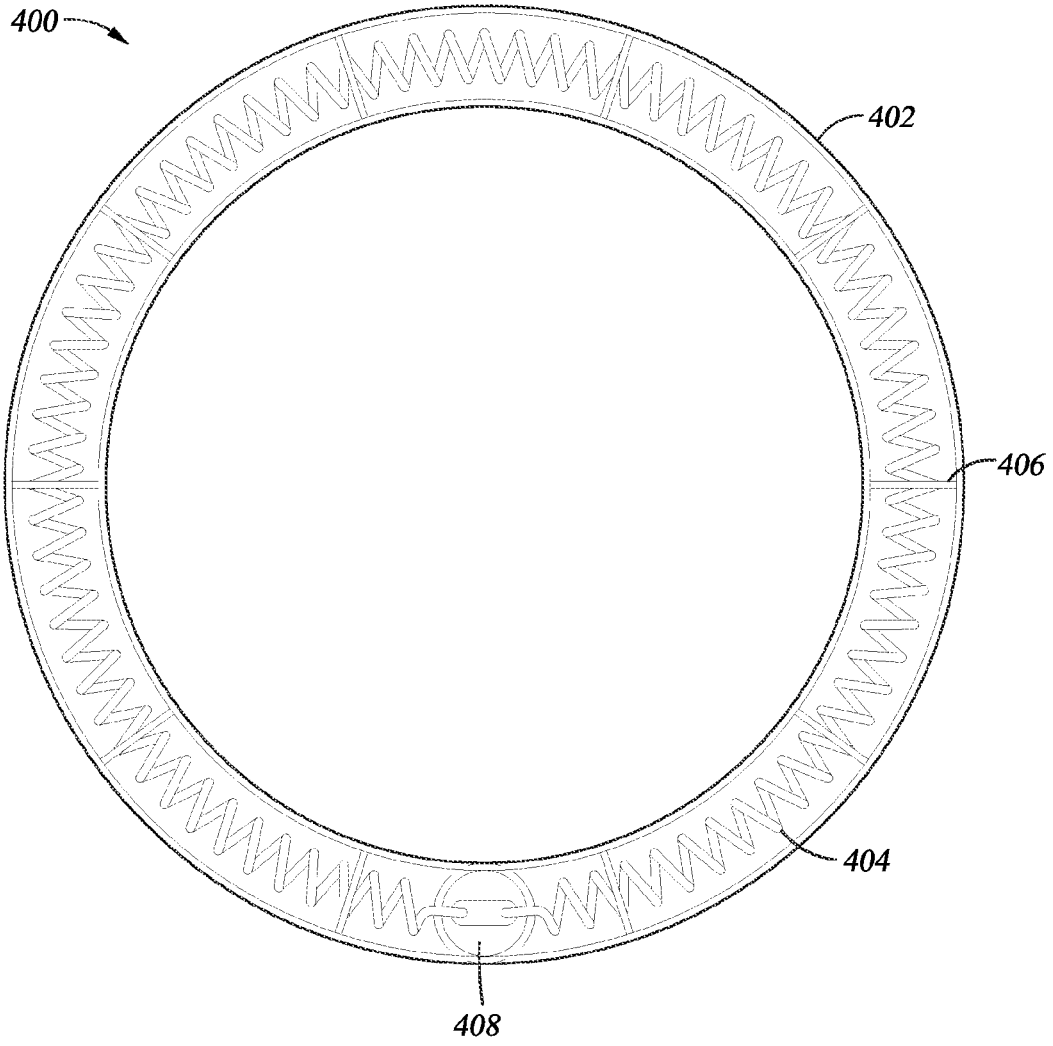
FIG. 4A is a top view of a tubular lamp according to one embodiment of the invention.

FIG. 4A is a top view of a tubular lamp 400 according to one embodiment of the invention. The tubular lamp 400 has a torroidal envelope 402 and a filament 404 disposed in the envelope 402 conforming to the shape of the envelope 402. The filament 404 may be a coiled filament with overwind or a coiled coil filament with overwind. A plurality of coil supports 406 are disposed spaced apart along the envelope 402. The lamp 400 has a single end 408.

Figure 4B:
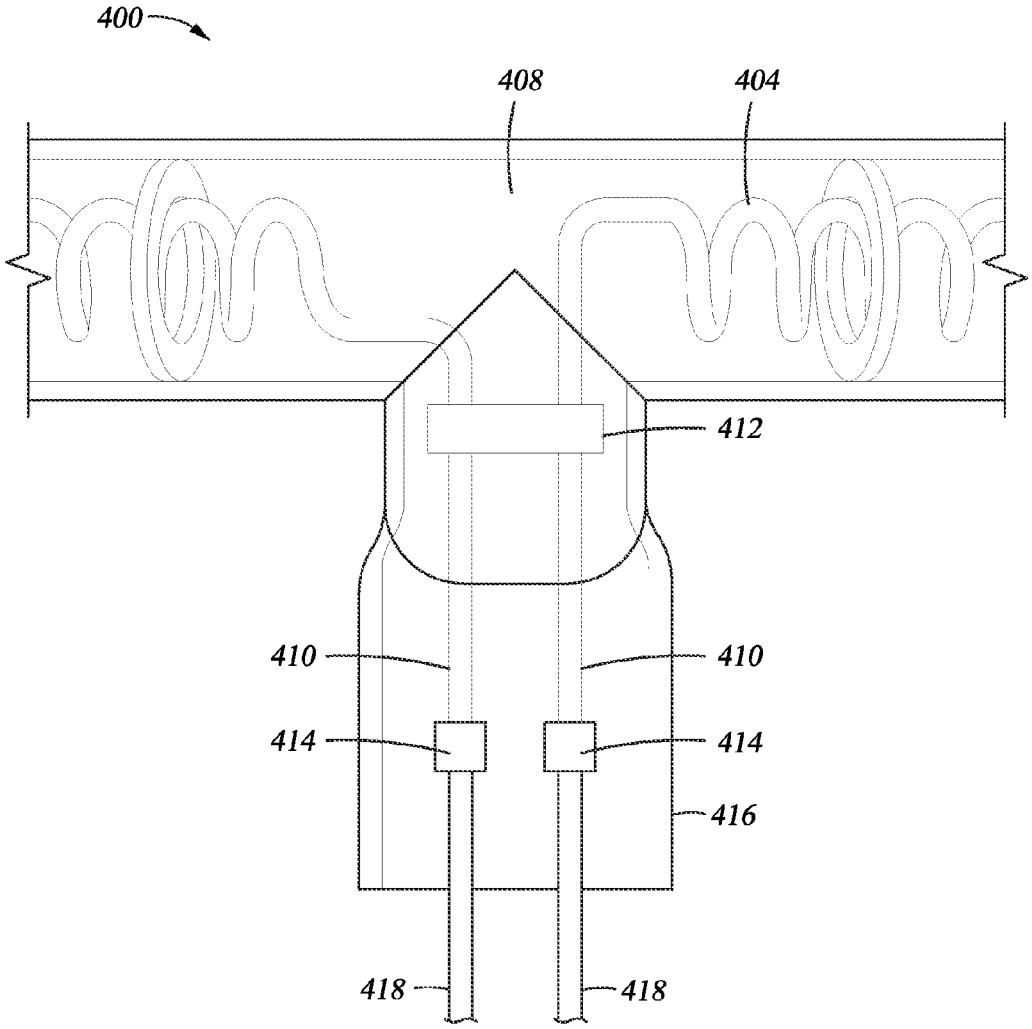
FIG. 4B is a partial side view of the tubular lamp in FIG. 4A according to one embodiment of the invention.

FIG. 4B is a partial side view of the lamp 400 at the end 408. The two ends of the filament 404 do not meet, instead each end of the filament 404 is attached to an inner lead 410 at the end 408. The inner leads 410 are held in place by a support 412. The inner leads 412 extend into a press seal 416, where the inner leads 410 are connected to outer leads 418 by foils 414.

Figure 5A:
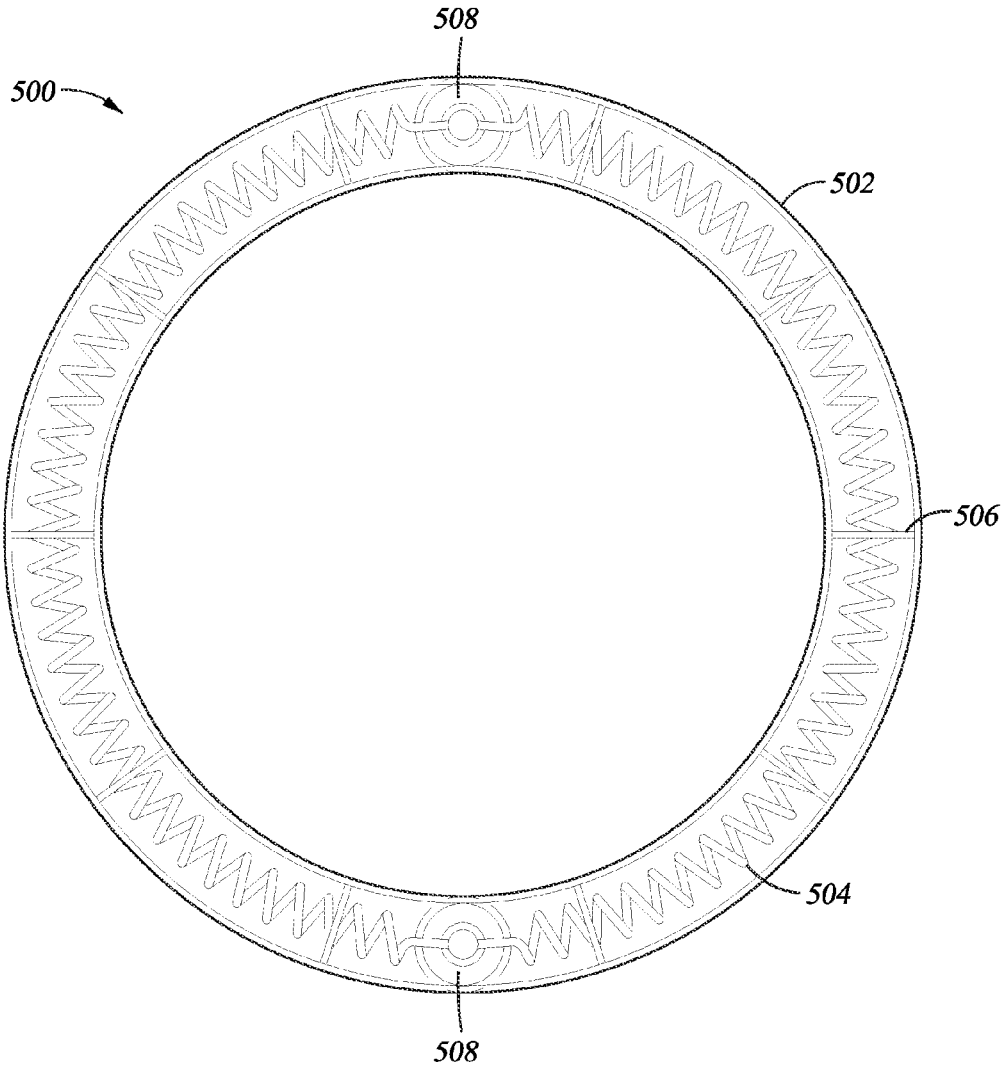
FIG. 5A is a top view of a tubular lamp according to one embodiment of the invention.

FIG. 5A is a top view of a tubular lamp 500 according to one embodiment of the invention. The tubular lamp 500 has a torroidal envelope 502 and a filament 504 disposed in the envelope 502 conforming to the shape of the envelope 502. The filament 504 may be a coiled filament with overwind or a coiled coil filament with overwind. A plurality of coil supports 506 are disposed spaced apart along the envelope 502. The lamp 500 has one or more ends 508. The ends 508 may be evenly spaced apart along the envelope 502.

Figure 5B:
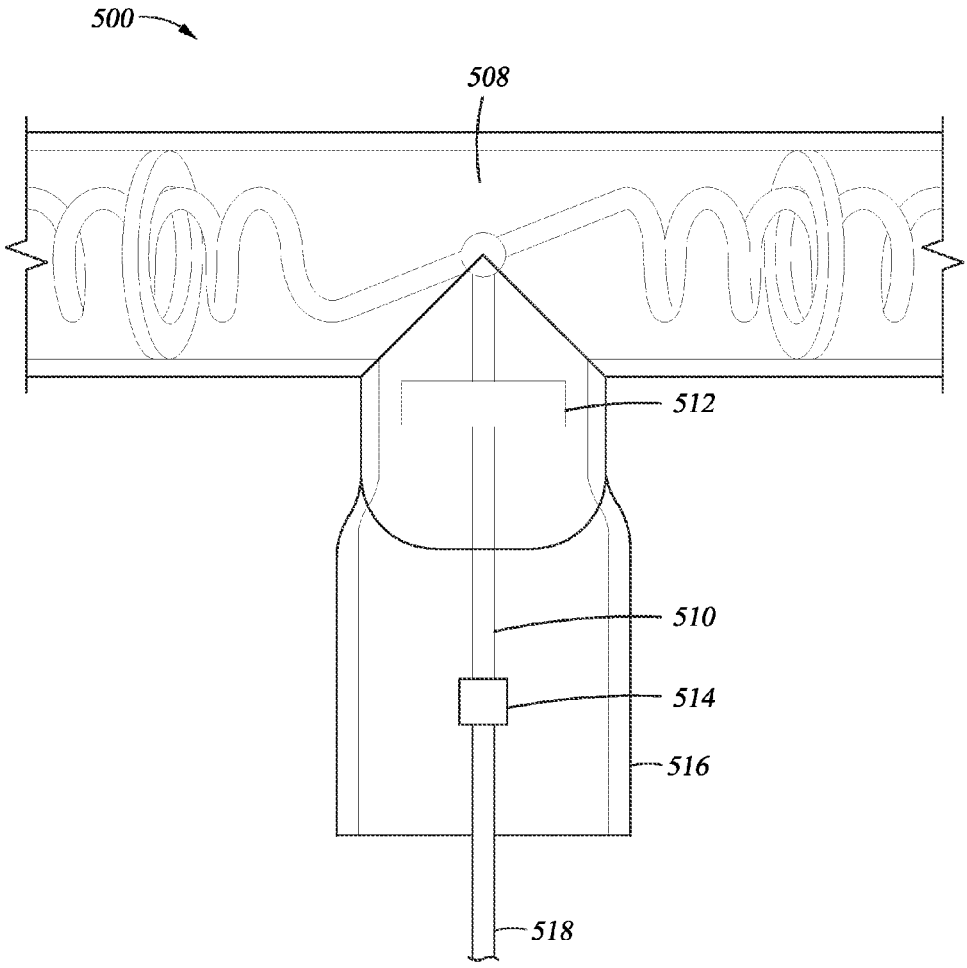
FIG. 5B is a partial side view of the tubular lamp in FIG. 5A according to one embodiment of the invention.

FIG. 5B is a partial side view of the lamp 500 at one end 508. The filament 504 may be a continuous loop and is connected to an inner lead 410 at the end 508. The inner lead 510 is held in place by a support 512. The inner lead 512 extends into a press seal 516, where the inner lead 510 is connected to an outer lead 518 by a foil 514.

In summary, a tubular lamp having a coil or coiled coil filament is disclosed. An overwind is wrapped around the coil or coiled coil filament. As a result, the surface area of the filament is increased and the filament temperature is reduced while maintaining the same radiant energy output.

While the foregoing is directed to embodiments of the present invention, other and further embodiments of the invention may be devised without departing from the basic scope thereof, and the scope thereof is determined by the claims that follow.

The invention claimed is:

1. A tubular lamp, comprising:

a tubular envelope having a first end and a second end;

a coiled filament having a first diameter, the coiled filament extending from the first end to the second end of the tubular envelope, wherein the coiled filament has an overwind having a second diameter and a pitch ratio between about 1.1 and about 2.0, and wherein the coiled filament comprises a coiled coil; and a ratio of the first diameter to the second diameter ranging from about 3:1 to about 15:1.

2. The tubular lamp of claim 1, wherein the coiled filament comprises potassium doped tungsten.

3. The tubular lamp of claim 2, wherein the overwind comprises tungsten.

4. The tubular lamp of claim 2, wherein the overwind comprises potassium doped tungsten.

5. The tubular lamp of claim 1, wherein the ratio of the first diameter to the second diameter is between about 6:1 and about 12:1.

6. The tubular lamp of claim 1, wherein the tubular envelope is an arc.

7. The tubular lamp of claim 1, wherein the tubular envelope is circular, wherein the first end and the second end abut.

8. A tubular halogen lamp for a rapid thermal processing (RTP) apparatus, comprising:

an envelope having a first end and a second end; and a coiled filament extending from the first end to the second end, wherein the coiled filament comprises a coiled coil, and wherein the coiled filament has an overwind, and the overwind has a pitch ratio between about 1.1 and about 2.0.

9. The tubular halogen lamp of claim 8, wherein the coiled filament comprises potassium doped tungsten.

10. The tubular halogen lamp of claim 9, wherein the overwind comprises tungsten.

11. The tubular halogen lamp of claim 9, wherein the overwind comprises potassium doped tungsten.

12. The tubular halogen lamp of claim 8, wherein the coiled filament has a first diameter and the overwind has a second diameter, wherein the ratio of the first diameter to the second diameter ranges from about 3:1 to about 15:1.

13. The tubular halogen lamp of claim 12, wherein the ratio of the first diameter to the second diameter is between about 6:1 and about 12:1.

14. The tubular lamp of claim 8, wherein the tubular envelope is substantially linear.

15. The tubular lamp of claim 8, wherein the tubular envelope is circular, wherein the first end and the second end abut.

16. A tubular halogen lamp for a rapid thermal processing (RTP) apparatus, comprising:

a torroidal envelope; and a continuous coiled filament having an overwind disposed in the envelope, wherein the coiled filament conforms to the shape of the envelope, wherein the coiled filament comprises a coiled coil and the overwind has a pitch ratio between about 1.1 and about 2.0.

* * * * *